US010975733B2

(12) United States Patent
Camprini et al.

(10) Patent No.: US 10,975,733 B2
(45) Date of Patent: Apr. 13, 2021

(54) COMPRESSOR DRIVEN BY ORC WASTE HEAT RECOVERY UNIT AND CONTROL METHOD

(71) Applicant: Nuovo Pignone Tecnologie Srl, Florence (IT)

(72) Inventors: Matteo Camprini, Florence (IT); Matteo Dall'Ara, Florence (IT); Filippo Cionini, Florence (IT); Sergio Mannucci, Florence (IT); Marco Rizzelli, Florence (IT); Sergio De Franciscis, Florence (IT); Marco Palladino, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 0 days.

(21) Appl. No.: 15/568,148

(22) PCT Filed: Apr. 22, 2016

(86) PCT No.: PCT/EP2016/059096
§ 371 (c)(1),
(2) Date: Oct. 20, 2017

(87) PCT Pub. No.: WO2016/170166
PCT Pub. Date: Oct. 27, 2016

(65) Prior Publication Data

US 2018/0142579 A1 May 24, 2018

(30) Foreign Application Priority Data

Apr. 24, 2015 (IT) ..... FI2015A000120

(51) Int. Cl.
*F01K 13/02* (2006.01)
*F01K 23/10* (2006.01)
(Continued)

(52) U.S. Cl.
CPC ..... *F01K 13/02* (2013.01); *F01D 15/12* (2013.01); *F01D 17/162* (2013.01); *F01D 19/02* (2013.01);
(Continued)

(58) Field of Classification Search
CPC ..... F01K 13/02; F01K 25/08; F01K 23/10; F01D 19/02; F01D 15/12; F01D 17/162; F05D 2260/85; F05D 2260/4031
(Continued)

(56) References Cited

U.S. PATENT DOCUMENTS 3,338,055 A * 8/1967 Gorzegno ..... F01K 3/22 122/406.1
4,226,086 A * 10/1980 Binstock ..... F01K 13/02 60/646
(Continued)

FOREIGN PATENT DOCUMENTS

EP 2390470 B1 3/2013
EP 2644867 B1 11/2019
(Continued)

OTHER PUBLICATIONS

Berti, M. et al., A Turboexpander and driven turbomachine system, GE co-pending Application No. FI2012A000196, filed on Oct. 1, 2012.
(Continued)

*Primary Examiner* — Hoang M Nguyen
(74) *Attorney, Agent, or Firm* — Baker Hughes Patent Organization

(57) ABSTRACT

A power converting system is described, comprising a source of waste heat and an organic Rankine cycle system. The organic Rankine cycle system in turn comprises at least a turboexpander, at least a rotating load mechanically coupled to the turboexpander and driven thereby, and a
(Continued)

variable-speed mechanical coupling between the turboexpander and the rotating load.

19 Claims, 4 Drawing Sheets

(51) Int. Cl.
*F01K 25/08* (2006.01)
*F01D 15/12* (2006.01)
*F01D 17/16* (2006.01)
*F01D 19/02* (2006.01)

(52) U.S. Cl.
CPC ..... *F01K 23/10* (2013.01); *F01K 25/08* (2013.01); *F05D 2260/4031* (2013.01); *F05D 2260/85* (2013.01)

(58) Field of Classification Search
USPC ..... 60/39.182, 614, 616, 618, 646, 657
See application file for complete search history.

(56) References Cited

U.S. PATENT DOCUMENTS 4,316,362 A * 2/1982 Ninomiya ..... F01D 13/003 60/646
6,339,926 B1 * 1/2002 Ichiro ..... F01K 23/108 60/39.182
6,442,941 B1 * 9/2002 Anand ..... F02C 7/32 60/39.182
6,571,548 B1 6/2003 Bronicki et al.
7,028,461 B2 4/2006 Goi
8,146,360 B2 * 4/2012 Myers ..... F01D 15/10 60/618
8,813,506 B2 * 8/2014 Hermsdorf ..... F01K 3/24 60/39.182
2003/0115877 A1 6/2003 Bara et al.
2004/0255593 A1 * 12/2004 Brasz ..... F02C 6/18 60/772
2007/0240420 A1 10/2007 Bronicki
2010/0281877 A1 * 11/2010 Asanaka ..... F01K 13/02 60/778
2011/0083437 A1 4/2011 Ast et al.
2013/0084164 A1 4/2013 Adachi et al.
2014/0090376 A1 4/2014 Burrato

FOREIGN PATENT DOCUMENTS

JP 2013-184613 A 9/2013
RU 2237815 C2 10/2004
SU 377531 A1 4/1973
WO 2005024188 A2 3/2005
WO 2013/167932 A1 11/2013

OTHER PUBLICATIONS

Burrato, A., An organic rankine cycle for mechanical drive applications, GE co-pending Application No. FI2012A000193, filed on Oct. 1, 2012.
Italian Search Report and Written Opinion issued in connection with corresponding IT Application No. ITFI2015A000120 dated Dec. 14, 2015.
International Search Report and Written Opinion issued in connection with corresponding Application No. PCT/EP2016/059096 dated Oct. 20, 2016.
International Preliminary Report on Patentability issued in connection with corresponding Application No. PCT/EP2016/059096 dated Nov. 2, 2017.

* cited by examiner

COMPRESSOR DRIVEN BY ORC WASTE HEAT RECOVERY UNIT AND CONTROL METHOD

FIELD OF INVENTION

The present application and the resultant patent relate generally to rotating loads, such as for instance compressors, driven by turbomachines. More specifically, embodiments disclosed herein concern Organic Rankine Cycles (ORC) in mechanical drive applications for driving rotary machines, such as compressors, in particular centrifugal or axial compressors.

BACKGROUND OF THE INVENTION

The need for energy saving and reducing environmental impact of energy-exploitation has stimulated research and development activities aimed at improving the overall efficiency of energy-conversion systems, both in the field of electric power generation, where mechanical power generated by a thermodynamic cycle is converted into electric power, as well as in mechanical drive applications, i.e. where mechanical power generated by a thermodynamic cycle is used to directly drive an operating machine, e.g. a compressor.

Combined systems, sometimes also called hybrid systems, have been developed for improving the overall power conversion efficiency and reducing both power consumption and environmental impact. A combined system combines a top, high-temperature thermodynamic cycle with a bottom, low-temperature thermodynamic cycle. Waste heat discharged at the low-temperature side by the top, high-temperature thermodynamic cycle is used as the source of thermal power for the bottom, low-temperature thermodynamic cycle. Typically, the top, high-temperature thermodynamic cycle is a gas turbine cycle. One or more gas turbines are used for powering an electric generator, or driving a rotary turbomachine, such as a compressor, e.g. a centrifugal compressor or a compressor train, a pump or the like. The exhaust combustion gas of the gas turbine is used to directly or indirectly heat a working fluid circulating in a closed circuit, where the bottom, low-temperature thermodynamic cycle is performed.

The bottom, low-temperature thermodynamic cycle converts part of the waste heat from the top, high-temperature thermodynamic cycle into mechanical power, which is usually used for driving an electric generator and produce electric power.

The bottom, low-temperature thermodynamic cycle usually comprises a Rankine cycle. In some known applications steam Rankine cycles are used. In other applications, so-called Organic Rankine Cycles are applied, wherein an organic fluid is used as the working fluid instead of water. Exemplary embodiments of ORCs utilize pentane or cyclopentane as working fluid.

FIG. 1 illustrates a schematic of a combined system using a top, high-temperature thermodynamic cycle combined with a bottom, low-temperature thermodynamic cycle for mechanical drive applications, i.e. for driving compressors or compressor trains.

Referring to FIG. 1, reference number 101 designates a gas turbine for driving a first compressor 102. Fuel F burned in the combustors of the gas turbine 101 is used to power the gas turbine and the thermal energy generated by combustion is partly converted into mechanical power. A portion of the mechanical power thus generated is required for driving the compressor of the gas generator of the gas turbine 101, while surplus mechanical power is available on the gas turbine output shaft and drives compressor 102. Low-temperature thermal power (waste heat), which is not converted into mechanical power by the gas turbine 101, is contained in the exhaust combustion gas, which flows through a waste heat recovery exchanger 103 before being discharged in the atmosphere.

In the waste heat recovery exchanger 103 at least part of the waste heat contained in the combustion gas is transferred to a first closed heat transfer loop 104, where a heat transfer fluid circulates by means of a circulating pump 106. The heat transfer fluid transfers thermal energy removed from the combustion gas into a closed circuit 105, wherein a working fluid is processed to perform a bottom, low-temperature thermodynamic cycle, which partly converts the waste heat from the top, high-temperature thermodynamic cycle into additional useful mechanical power.

The working fluid, e.g. cyclopentane, or a mixture of two or more hydrocarbons, circulating in the closed circuit 105 is subject to cyclic thermodynamic transformations including condensing, pumping, heating, vaporizing, superheating, expanding, to transform heat power from the waste heat recovery exchanger 103 into mechanical power. The closed circuit 105 comprises a circulating pump 107, a preheater 109*a*, a vaporizer 109, a superheater 111, a turboexpander 113, a recuperator 115 and a condenser 117.

Mechanical power generated by the turboexpander 113 is used to drive an electric generator 121. Electric power from the electric generator 121 can then be used to power an electric motor 123, which in turns drives a second compressor 125. In this configuration the second compressor 125 is mechanically decoupled from the turboexpander 113, since the latter is usually rotated at a constant speed, corresponding to the operative speed of the electric generator 121, while the compressor 125 may require rotating at variable speed. A variable frequency driver 124 is provided for driving the electric motor 123 at variable rotary speed.

The system of FIG. 1 is relatively complex, especially in view of the need for two electric machines 121, 123 and a variable frequency driver 124. The conversion of mechanical power into electric power by the electric generator 121 and the opposite conversion of electric power into mechanical power by the electric motor 123 negatively affects the overall conversion efficiency of the system. The need for a variable frequency driver further reduces the efficiency and adds to the overall cost and complexity of the combined cycle.

There is therefore a need for a simpler and more efficient combined system for mechanical drive applications.

SUMMARY OF THE INVENTION

The present application and the resultant patent thus provide a power converting system comprising a source of waste heat and an Organic Rankine Cycle (ORC) system, comprised of at least a turboexpander, at least a rotating load mechanically coupled to the turboexpander and driven thereby, and a variable-speed mechanical coupling between the turboexpander and the rotating load. The organic Rankine cycle system comprises a circuit with a high pressure side, a low pressure side and a turboexpander between the high pressure side and the low pressure side. A working fluid is pumped from the low pressure side to the high pressure side and is heated by means of heat from the waste heat source. Hot, pressurized working fluid expands in the turboexpander and mechanical power is generated thereby. The mechanical power is used to drive an output shaft of the turboexpander. The turboexpander output shaft is mechanically coupled via the variable-speed mechanical coupling to the driven shaft of the rotating load.

As will become apparent from the disclosure of some exemplary embodiments, the variable-speed mechanical coupling enables start-up of the organic Rankine cycle system and acceleration of the rotating load, as well as control of the rotating speeds under variable operating conditions.

The system can further comprise a gas turbine system having least a gas turbine engine and at least one further rotating load driven by said gas turbine engine. The waste heat exploited by the organic Rankine cycle system is the thermal energy contained in exhaust combustion gases from the gas turbine engine. A heat exchange system can be provided for transferring waste heat from the gas turbine system to the organic Rankine cycle system.

The rotating load driven by the turboexpander can include a turbomachine, such as in particular a compressor. Similarly, the rotating load driven by the gas turbine engine can include a turbomachine, e.g. a compressor. The two compressors can be arranged in parallel.

In some embodiments, the turboexpander comprises variable inlet guide vanes, in order to controllably vary the flow rate of working fluid expanding through the turboexpander.

In some embodiments, the organic Rankine cycle system comprises a turboexpander inlet collector with an inlet pressure controller arranged and configured to maintain the pressure in the turboexpander inlet collector at a steady-state turboexpander inlet pressure. In some embodiments, a further inlet pressure controller is provided, arranged and configured to control a by-pass valve connecting the turboexpander inlet collector to the low-pressure side of the organic Rankine cycle system. The further inlet pressure controller can have a pressure set-point higher than the steady-state turboexpander inlet pressure. The inlet pressure controller having a lower set-point pressure can be enabled upon reaching of a rotary speed of the turboexpander and/or of the rotating load driven thereby. The inlet pressure controller having the higher pressure set-point will then close the bypass valve.

According to a further aspect, disclosed herein is a method for managing a power conversion system including an organic Rankine cycle system thermally coupled to a waste heat source and comprising: at least a turboexpander; at least a rotating load mechanically coupled to the turboexpander and driven thereby; and a variable-speed mechanical coupling between the turboexpander and the rotating load. According to some embodiments, the method comprises the step of acting upon the variable-speed mechanical coupling to control the mechanical power transmitted from the turboexpander to the rotating load.

According to some embodiments, the method comprises the steps of: accelerating the turboexpander to a first, warm-up speed and subsequently accelerating the turboexpander to a rated operating speed, higher than the warm-up speed; accelerating the rotating load to a minimum load operative speed and subsequently accelerating the rotating load to a full operative speed, higher than the minimum load operative speed, while maintaining the turboexpander at or around the rated operating speed.

Embodiments of the method disclosed can further comprise the following steps: providing a turboexpander inlet collector fluidly coupled to a turboexpander inlet; providing at least a start-up valve located between the turboexpander inlet collector and the turboexpander inlet; providing variable inlet guide vanes at the turboexpander inlet; accelerating said rotating load by increasing a flow rate of a working fluid through the turboexpander by opening of the variable inlet guide vanes.

Additionally, the method can further comprise the following steps: accelerating the turboexpander to said warm-up speed by gradually opening the start-up valve, while the variable inlet guide vanes are at least partly open; further accelerating the turboexpander to said full operative speed by gradually opening the variable inlet guide vanes.

In some embodiments, the turboexpander is firstly accelerated by gradually opening the start-up valve, while the variable inlet guide vanes are fully open; the variable inlet guide vanes are partly closed while the start-up valve further opens; and the turboexpander is accelerated up to rated operating speed by again gradually opening the variable inlet guide vanes.

The method can further comprise the steps of: providing an inlet pressure controller controlling the inlet pressure in the turboexpander inlet collector; enabling the inlet pressure controller when the rotating load achieves the minimum load operative speed; generating a pressure control signal which is applied to the variable-speed mechanical coupling to accelerate the rotating load; maintaining the turboexpander at or around the rated operating speed while the rotating load is accelerated by increasing the flow rate of working fluid expanding through the turboexpander.

The turboexpander can be maintained at the rated operating speed by modulating the rotation speed of the rotating load through action upon the variable-speed mechanical coupling for compensating a pressure variation in the turboexpander inlet collector.

The method can comprise the following further steps: accelerating the turboexpander to the rated operating speed by increasing a working fluid flow rate through the turboexpander through a first turboexpander speed control loop; upon reaching the rated operating speed of the turboexpander, activating a rotating load speed control loop; accelerating the rotating load by increasing the flow rate of the working fluid through the turboexpander until full operative speed of the rotating load is achieved, while maintaining the turboexpander speed at or around the rated operating speed by acting upon the variable-speed mechanical coupling.

In some embodiments, upon reaching of the rated operative speed of the turboexpander and during acceleration of the rotating load, the turboexpander speed can be maintained at or around the rated operating speed by enabling a second turboexpander speed control loop, the second turboexpander speed control loop generating a signal which varies the torque transmitted through the variable-speed mechanical coupling to counteract a turboexpander speed variation caused by the increased working fluid flow rate through the turboexpander.

The step of accelerating the rotating load can be performed under the control of selectively a first load speed control loop and of a second load speed control loop, the first load speed control loop being operative until the minimum load operative speed is achieved, the second load speed control loop being enabled upon achieving the minimum load operative speed and controlling the speed of the load above said minimum load operative speed.

Methods disclosed herein can further comprise the following steps: accelerating the turboexpander to the rated operating speed by increasing a working fluid flow rate through the turboexpander through a first turboexpander control loop; upon reaching the rated operating speed of the turboexpander, enabling a rotating load speed control and generating a load speed control signal therewith; accelerating the load up to a full operative speed; enabling an inlet pressure controller on a turboexpander inlet collector, having a pressure set-point and generating a pressure control signal therewith; selecting the minimum signal between the load speed control signal and the pressure control signal; applying said minimum signal to variable inlet guide vanes of the turboexpander.

A step of maintaining the turboexpander at or around the rated operating speed by means of a turboexpander speed controller acting upon the variable-speed mechanical coupling can further be provided.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF THE INVENTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of an embodiment is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1:
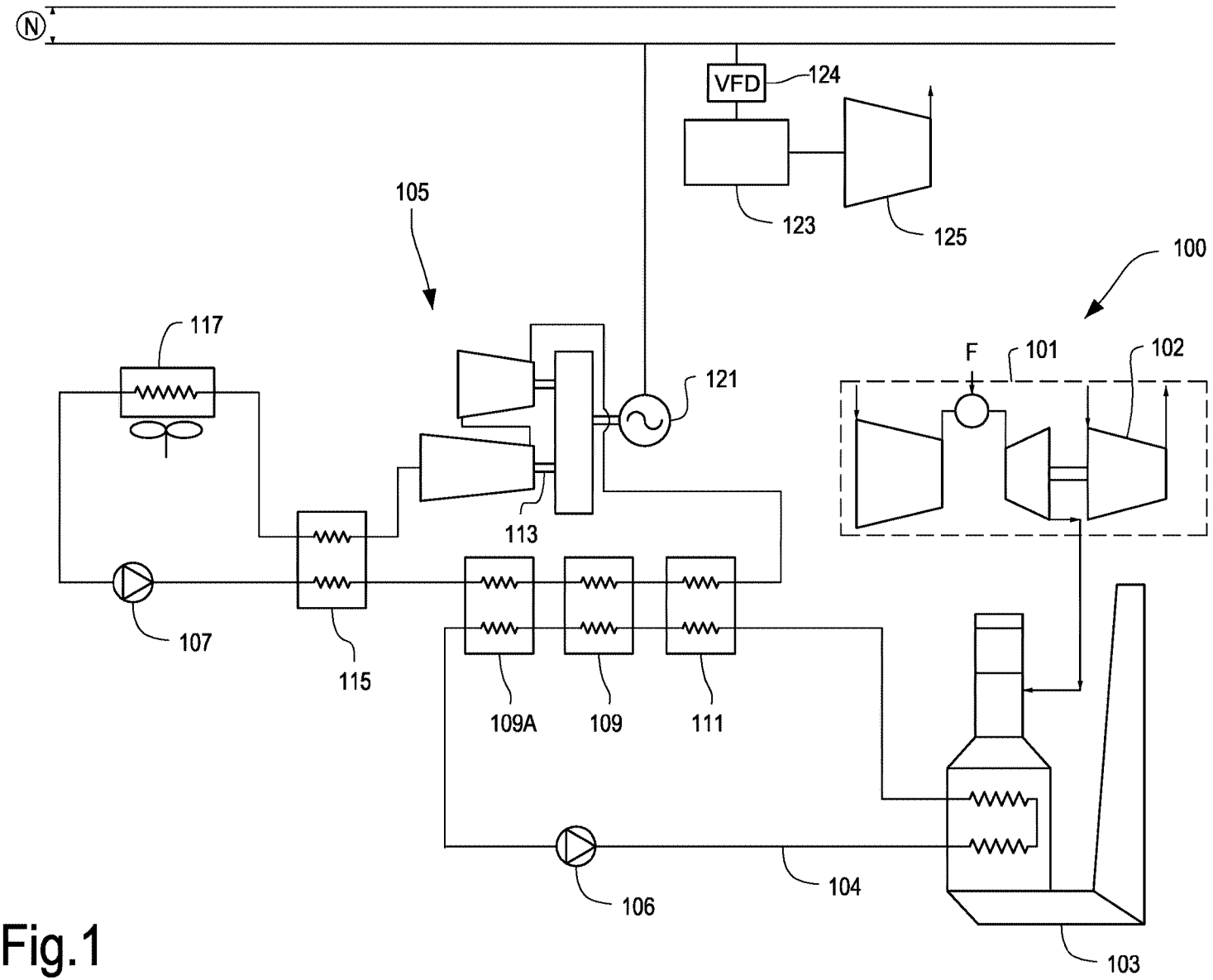
FIG. 1 illustrates a combined cycle according to the current art.
Figure 2:
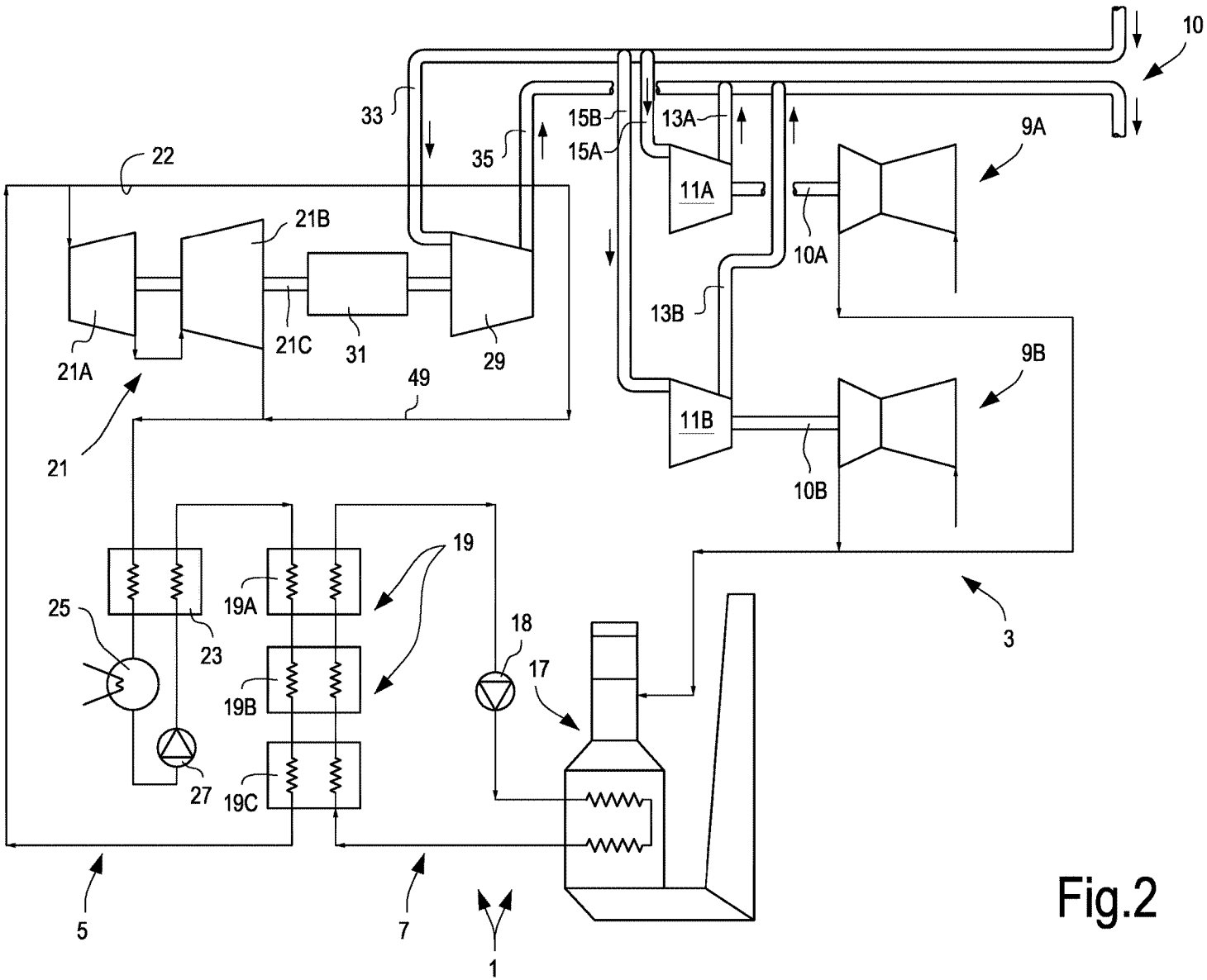
FIG. 2 illustrates a combined system according to the present disclosure.

FIG. 2 schematically illustrates a combined or hybrid system 1 for mechanical drive applications. In the exemplary embodiment of FIG. 2 the mechanical power generated by the turbomachines of the system is used for driving compressors of a gas pipeline. In other embodiments the mechanical power can be used for driving other turbomachines, e.g. turbo-compressors for different applications, such as natural gas liquefaction, or other industrial applications, or a different kind of load.

In general terms, the system of FIG. 2 comprises a gas turbine system 3 including one or more gas turbine engines. A top, high-temperature thermodynamic cycle is performed in the gas turbine system 3 to produce useful mechanical power by expanding the combustion gas in the gas turbine(s). The exhausted combustion gas from the gas turbine system 3 still contains useful thermal energy, which can be partly converted in further mechanical power. Waste heat contained in the exhausted combustion gas discharged from the top, high-temperature thermodynamic cycle is thus transferred to a bottom, low-temperature thermodynamic cycle. The bottom, low-temperature thermodynamic cycle is an Organic Rankine Cycle (ORC). An organic working fluid of the ORC circulates in a closed circuit of an ORC system 5, and undergoes cyclic thermodynamic transformations for converting part of the waste heat from the top, high-temperature thermodynamic cycle into useful mechanical power.

In the context of the present disclosure, the term "thermodynamic cycle" will sometimes be used also to designate the system wherein the thermodynamic cycle is performed. For instance the term "top, high-temperature thermodynamic cycle" can be used to designate the gas turbine system; the term "bottom, low-temperature thermodynamic cycle" can be used to designate the combination of machines and devices wherein the organic working fluid is processed and is subject to the cyclic thermodynamic transformations that form the thermodynamic cycle.

An intermediate heat transfer loop 7 can be provided for indirect transfer of thermal power from the top, high-temperature thermodynamic cycle to the bottom, low-temperature thermodynamic cycle.

More specifically, according to some embodiments the top, high-temperature thermodynamic cycle or gas turbine system 3 can comprise one or more gas turbine engines. In the embodiment illustrated in FIG. 2, two gas turbine engines 9A, 9B are provided, arranged in parallel. Each gas turbine engine 9A, 9B comprises an air compressor, a combustor and a power turbine, not shown in detail. The air compressor of each gas turbine engine 9A, 9B compresses ambient air, which is then delivered to the combustor and mixed with a liquid or gaseous fuel. The air-fuel mixture is ignited to generate compressed, high temperature combustion gas, which expands in the power turbine, whereby mechanical power is generated. The mechanical power is partly used to drive the air compressor of the respective gas turbine engine, to provide compressed air to the combustor, and partly made available on an output shaft 10A, 10B and used to drive a first rotating load, for instance including a rotating turbomachinery, e.g. an axial or centrifugal compressor 11A, 11B, respectively.

In the exemplary embodiment of FIG. 2, a gaseous medium, e.g. natural gas from a pipeline 10, is fed to compressors 11A, 11B through suction lines 15, 15. The compressors boost the pressure of the gaseous medium, which is then delivered through delivery lines 13, 13 to the pipeline 10 again. Part of the gas processed by the compressors 11A, 11B can be used as fuel for powering the gas turbine engines 9A, 9B.

Exhaust combustion gas from the gas turbine engines 9A, 9B flows through a waste heat recovery exchanger 17 before being finally discharged in the atmosphere.

Part of the waste heat contained in the exhaust combustion gas is transferred by the waste heat recovery exchanger 17 to a heat transfer fluid circulating by means of a pump 18 in the heat transfer loop 7.

Through a heat exchange arrangement 19, heat is transferred from the heat transfer fluid circulating in heat transfer loop 7 to the working fluid, e.g. pentane or cyclopentane, circulating in ORC system 5. The heat exchange arrangement 19 can include a pre-heater 19A, a vaporizer 19B and a superheater 19C. Other heat exchange arrangements are possible, with a larger or smaller number of heat exchangers.

The ORC system 5 can comprise one or more turboexpanders. In the exemplary embodiment of FIG. 2 one turboexpander 21 is provided. The turboexpander 21 can be a multi-stage turboexpander. In the exemplary embodiment of FIG. 2 the turboexpander 12 is a two-stage turboexpander. Reference number 21A designates a high-pressure turboexpander stage and reference number 21B designates a low-pressure turboexpander stage. In other embodiments, a single-stage turboexpander can be used. In yet further embodiments, a turboexpander including more than two stages can also be used.

The two or more turboexpander stages can rotate at different rotational speeds, with a fixed speed ratio. A gearbox arrangement is provided on the shaftline connecting the first and the second turboexpander stages. The gearbox arrangement is not shown in the schematic of FIG. 2.

Alternatively, the multi-stage turboexpander 21 can be an integrally geared turboexpander.

In the following description, reference will be made to the speed of the turboexpander. If the turboexpander comprises more than one rotating shaft, and if the shafts rotate at different speeds, with a constant speed ratio between shafts, the turboexpander speed can be any one of the different shaft speeds. For instance, if a two-stage, integrally geared turboexpander is used, the first, high-pressure stage can be supported by a first, fast-rotating shaft, while the second, low-pressure stage can be supported by a second, slow-rotating shaft. The "turboexpander speed" as understood herein can then be either the speed of the fast-rotating shaft, or the speed of the slow-rotating shaft, or the speed of the output shaft of the integrally geared turboexpander.

The turboexpander 21, or one or more of the turboexpander stages can be provided with variable inlet nozzles, i.e. variable inlet guide vanes, which can be used to control the flow rate of process fluid entering the turboexpander and the enthalpy drop across each stage. In the exemplary embodiment of FIG. 3 both turboexpander stages 21A, 21B are provided with variable inlet guide vanes (also shortly "variable IGV") or variable inlet nozzles, schematically shown at 57A and 57B, respectively. As known to those skilled in the art, the two sets of variable inlet guide vanes can be controlled by a single control signal or by separate control signals. A specific relation between the movements of the two sets of variable inlet guide vanes can be provided. In some embodiments, the inter-stage pressure, the inlet pressure and the outlet pressure of the turboexpander 21 can be detected and the ratio between the movement of the two sets of variable inlet guide vanes can be set or modified during operation, in a manner known per se, to optimize the efficiency of the turboexpander, based on the inlet, outlet and inter-stage pressure values. Other embodiments may control the inlet nozzles or variable inlet guide vanes with a completely separate logic depending upon thermodynamic or mechanical considerations.

Heated, pressurized working fluid circulating in the closed circuit of the ORC system 5 is delivered to the inlet of the turboexpander 21 through a turboexpander inlet collector 22.

The closed circuit of the ORC system 5 can further include a recuperator 23, in fluid communication with the outlet of the turboexpander 21. A condenser 25 can be arranged downstream of the recuperator 23 for condensing the spent working fluid discharged from the turboexpander 21. A pump 27 is further provided for pumping the cooled and condensed working fluid at a high pressure and for feeding the pressurized liquid working fluid through the cold side of recuperator 23 and through the cold side of the heat exchange arrangement 19, where the working fluid is heated, vaporized and superheated before being finally delivered to the turboexpander inlet collector 22 for expansion in the turboexpander 21.

The working fluid circulating in the bottom, low-temperature thermodynamic cycle 5 is subjected to cyclic thermodynamic transformations to convert part of the thermal power delivered thereto by the heat exchange arrangement 19 into mechanical power, which is available on an output shaft 21C of the turboexpander 21 and can be used to drive a second rotating load. In some embodiments the second rotating load comprises a turbomachinery, such as a compressor 29, or a compressor train. A variable-speed mechanical coupling 31 is provided between the output shaft 21C of the turboexpander 21 and the compressor 29. Reference number 31A designates the output shaft of the variable-speed mechanical coupling 31. The variable-speed mechanical coupling 31 allows operating the compressor 29 at a speed different from the rotary speed of the turboexpander 21 and variable independently of the latter.

A suitable variable-speed mechanical coupling is the VORECON Variable Speed Planetary Gear, available from Voith Turbo GmbH & Co KG, Germany.

The compressor 29 can be fluidly coupled to the same pipeline 10, whereto compressors 11A and 11B are connected. As schematically shown in FIG. 2, the compressor 29 can be connected to the pipeline 10 by means of a suction line 33 fluidly coupled to the suction side of compressor 29, and by means of a delivery line 35 fluidly coupled to the delivery or pressure side of compressor 29. With this arrangement, compressors 11A, 11B and 29 are placed in parallel on the same pipeline 10 and all contribute to the total gas flow rate through the pipeline 10. Other arrangements are possible. For instance the compressor 29 can be used to process a gas different from the gas processed by compressors 11A, 11B, or a series rather than a parallel compressor arrangement can be envisaged.

Thanks to the waste heat recovery through the bottom, low-temperature thermodynamic cycle performed in the ORC system 5, the flow rate through compressor 29 reduces the amount of gaseous medium processed by the compressors 11A, 11B, such that the total amount of high-quality energy required for powering the gas turbine engines 9A, 9B can be reduced and fuel can be saved. Alternatively, a higher flow rate of gaseous medium can be processed by the compressor arrangement 11A, 11B, 29, using the same amount of fuel. As will become clearer from the following description, as a general rule the bottom, low-temperature thermodynamic cycle can be controlled so as to always exploit the entire thermal energy made available by the waste heat recovery exchanger 17.

Figure 3:
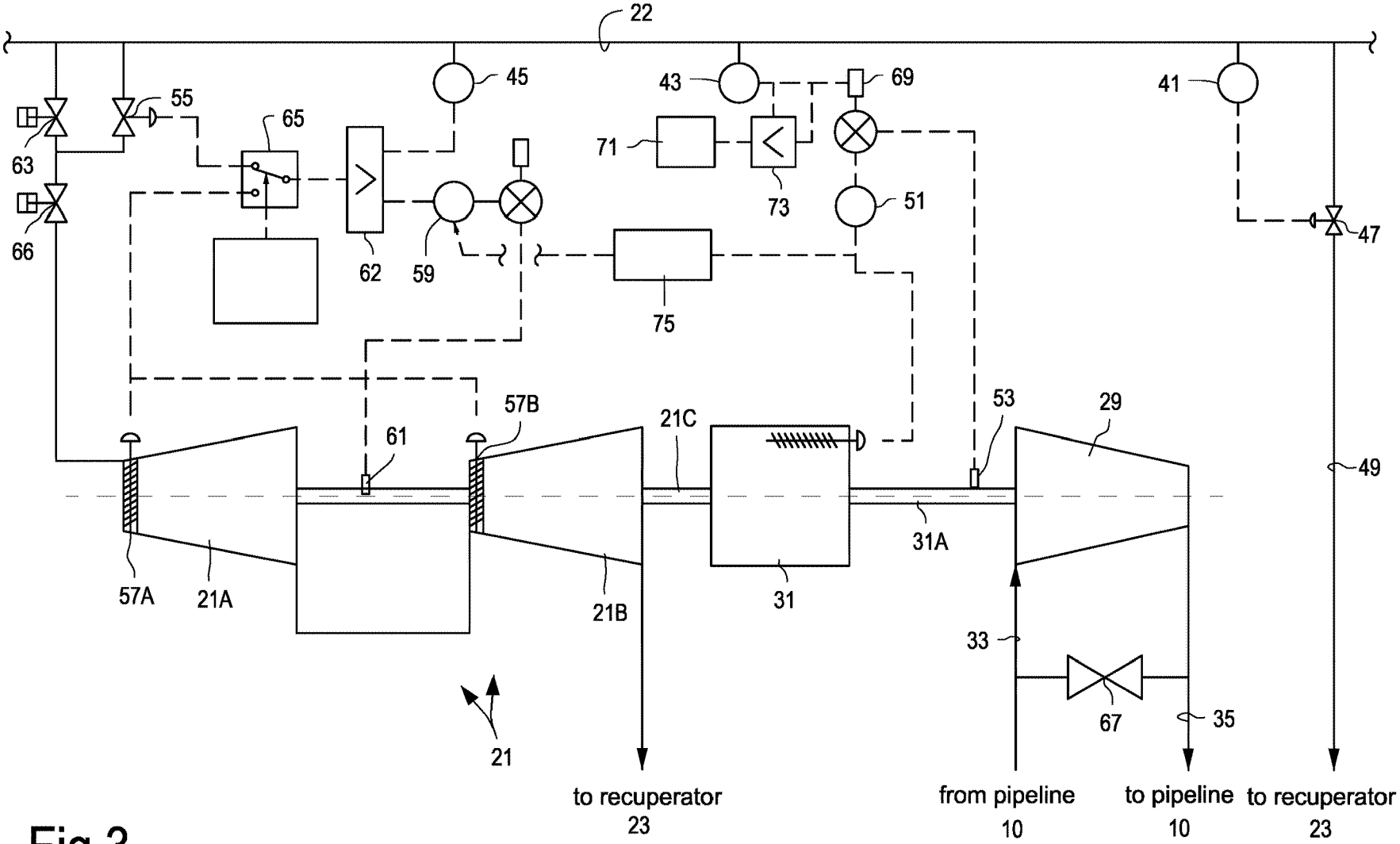
FIG. 3 illustrates a schematic of the control system for the bottom, low-temperature thermodynamic cycle.

FIG. 3 schematically illustrates the main components of the ORC system 5, in combination with an exemplary arrangement of devices used for controlling the rotary machines thereof, namely the turboexpander 21, the variable-speed mechanical coupling or gearbox 31, and the compressor 29. The same reference numbers are used to designate the same elements shown in FIG. 2.

In FIG. 3 a first inlet pressure controller 41, a second inlet pressure controller 43 and a third inlet pressure controller 45 are shown. The first inlet pressure controller 41 is configured for acting upon a by-pass valve 47 placed on a by-pass line 49. The by-pass line 49 connects the turboexpander inlet collector 22 to the recuperator 23 or to the condenser 25, bypassing the turboexpander 21.

The second inlet pressure controller 43 is functionally combined with a compressor speed controller 51 and with a compressor speed transducer 53. The compressor speed controller 51 is functionally connected to the variable-speed mechanical coupling 31.

The third inlet pressure controller 45 is configured and arranged for acting selectively upon a start-up valve 55 and the variable inlet guide vanes or inlet nozzles 57A, 57B of the first turboexpander stage 21A and the second turboexpander stage 21B, respectively. In other embodiments, e.g. if a single-stage turboexpander is provided, only one set of variable inlet nozzles, or inlet guide vanes will be required.

As noted above, in some embodiments the variable inlet guide vanes 57A, 57B can be linked so as to be controlled with a single control signal.

Reference number 59 designates a turboexpander speed controller, which is functionally connected to a turboexpander speed transducer 61 and to a selector 62, which is further connected to the third inlet pressure controller 45. The output of the selector 62 is applied to a switching block 65. The switching block 65 is configured for diverting a control signal from the third inlet pressure controller 45 or from turboexpander speed controller 59 selectively to the start-up valve 55, or to variable inlet guide vanes 57A, 57B, depending upon the operating stage of the ORC system.

According to some embodiments, a controlled turboexpander inlet valve 63 can be arranged in parallel to the turboexpander start-up valve 55. In some embodiments, an on/off valve 66 can be further provided and arranged in series to turboexpander inlet valve 63 and turboexpander start-up valve 55. In other embodiments, a single valve or a two-valve arrangement can be used instead of the three-valve system 55, 63, 66.

Further elements for controlling the operation of the ORC system 5 can include a compressor by-pass valve 67, which connects the compressor delivery side with the compressor suction side. The compressor by-pass valve 67 can be an anti-surge valve of the compressor 29.

The control arrangement disclosed so far is used to control various steps of the operation of the ORC system 5 from initial conditions to load control. Possible control methods will now be described, specifically referring to the schematic of FIG. 3.

When the operation of the bottom, low-temperature thermodynamic cycle of the ORC system 5 is first started, the following initial conditions apply. The on/off valve 66, the turboexpander inlet valve 63 and the turboexpander start-up valve 55 are closed. The variable-speed mechanical coupling 31 is set at a minimum (minimum output shaft speed, minimum load condition). The variable inlet guide vanes or nozzles 57A, 57B of the turboexpander stages 21A, 21B are fully open. The compressor by-pass valve 67 is fully open.

When the ORC system 5 is started, the first inlet pressure controller 41 is enabled to control the by-pass valve 47. The pressure set-point of the first inlet pressure controller 41 will be indicated as P1 and designated "start-up pressure". The start-up pressure is set slightly higher, e.g. about 0.5 bar higher than an operating turboexpander inlet pressure in steady-state conditions, here below indicated as P2 (steady-state turboexpander inlet pressure). The steady-state turboexpander inlet pressure can be set e.g. at about 39.5 bar and the start-up pressure P1 can be set e.g. at about 40 bar. It shall be understood that these numerical values are merely by way of example and shall not be construed as limiting the scope of the present disclosure.

Start-up of the system is as follows. When waste heat is available from the gas turbine system 3, the working fluid of the bottom, low-temperature thermodynamic cycle in ORC system 5 starts heating up. Until the start-up valve 55, the inlet valve 63 and/or the on/off valve 66 are closed, the entire working fluid circulating in the ORC system 5 by-passes the turboexpander 21 through by-pass line 49, the by-pass valve 47 being open.

The on/off valve 66 is fully opened. The turboexpander speed controller 59 is enabled and takes over the control of the turboexpander speed until a warm-up speed $\omega_{warm\text{-}up}$ of the turboexpander 21 will be achieved. The control signal from turboexpander speed controller 59 is applied to start-up valve 55, which is gradually opened to divert an increasing amount of flow of heated and pressurized working fluid towards the turboexpander 21. The remaining working fluid flow continues to be diverted through the by-pass valve 47 and the by-pass line 49 towards the condenser 25. The by-pass valve 47 is maintained open under the control of the first inlet pressure controller 41.

The gradual opening of the start-up valve 55 continues until the warm-up speed $\omega_{warm\text{-}up}$ is achieved, which can be e.g. in the range of approximately 20%-40% of a turboexpander rated operating speed $\omega_{exp\text{-}operating}$, i.e. the design operating speed of the turboexpander 21.

When the warm-up speed $\omega_{warm\text{-}up}$ has been achieved, the turboexpander 21 is maintained at said speed for a pre-set warm-up time interval $\Delta t_{warm\text{-}up}$.

According to some embodiments, once the warm-up time interval $\Delta t_{warm\text{-}up}$ has elapsed, the output of the turboexpander speed controller 59 is routed by switching block 65 to the variable inlet guide vanes or nozzles 57A, 57B of the turboexpander 21. The start-up valve 55 is gradually brought in full-open condition. The turboexpander rotary speed is now controlled by the output signal of the turboexpander speed controller 59 applied to the variable inlet guide vanes 57A, 57B, the output signal being determined on the basis of the speed signal from turboexpander speed transducer 61. The turboexpander speed is maintained around the warm-up speed $\omega_{warm\text{-}up}$, while opening of start-up valve 55 continues. Gradual closing of the variable inlet guide vanes 57A, 57B maintains the turboexpander at or around the warm-up speed $\omega_{warm\text{-}up}$. Since the variable inlet guide vanes 57A, 57B of the two turboexpander stages 21A, 21B may be mutually coupled, a single control signal may be sufficient for controlling both variable inlet guide vanes.

According to other embodiments, the turboexpander speed control can be switched to the variable inlet guide vanes 57A, 57B prior to the end of the warm-up time interval, such that once the warm-up time interval has elapsed, the variable inlet guide vanes 57A, 57B are partly closed while the start-up valve 55 is fully open.

Once the start-up valve 55 is fully open, the turboexpander inlet valve 63 is opened and subsequently the turboexpander start-up valve 55 is closed.

In other embodiments, a single valve can be used instead of the paralleled valves 55, 63. In such case, the above described process will be simplified and just one single valve will be controlled to gradually open until the full-open condition is achieved. In some particularly simple embodiments, the three-valve arrangement 55, 63, 66 can be replaced by a single valve. In such case, the above described process will be performed by acting upon the single valve, which is controlled to gradually move from a fully closed to a fully opened condition.

During the above described phase, the compressor 29 is stationary or rotates at slow speed, since the variable-speed mechanical coupling 31 is set at a minimum.

Once the warm-up time interval $\Delta t_{warm\text{-}up}$ has elapsed, the system is ready for gradually increasing the turboexpander speed from the warm-up speed $\omega_{warm\text{-}up}$ to its rated operating speed $\omega_{exp\text{-}operating}$. The variable inlet guide vanes 57A, 57B are now partly closed as a result of the previous phase, and can be acted upon for increasing the working fluid flow rate through the turboexpander 21 and thus accelerating the turboexpander 21.

Turboexpander acceleration is performed under the control of the turboexpander speed controller 59 acting upon the variable inlet guide vanes 57A, 57B, which are gradually opened. During acceleration of the turboexpander 21 the critical speeds can be skipped by means of a suitable critical speed band skip function.

The compressor speed also may increase, as it is mechanically coupled to the axis of the turboexpander 21 through the variable-speed mechanical coupling 31.

Gradual opening of the variable inlet guide vanes 57A, 57B of the turboexpander 21 during this start-up phase through turboexpander speed controller 59 increases the amount of working fluid flowing through the turboexpander 21. The first inlet pressure controller 41 maintains the pressure in the turboexpander collector 22 at the pressure set-point P1 by gradually closing the by-pass valve 47, thus reducing the by-passed flow rate. The second inlet pressure controller 43, having a pressure set-point P2 (steady-state turboexpander inlet pressure) lower than P1 is temporarily disabled.

During this start-up phase the compressor 29 is accelerated up to a minimum compressor operative speed $\omega_{min\text{-}comp\text{-}speed}$, which can be in the range of approximately 20-70% of its design operation speed, while the compressor by-pass valve 67 is still open and therefore the compressor is in full-recycle condition. The compressor speed is achieved thanks to the setting of the variable-speed mechanical coupling 31 during start-up.

The compressor speed control is activated after the turboexpander speed has stabilized at its rated operating speed $\omega_{exp\text{-}operating}$. If needed, the compressor speed is brought to its minimum operative value by adjusting the demand to the variable-speed mechanical coupling 31, while the compressor is still operated in full-recycle condition (compressor by-pass valve 67 fully open).

Once the minimum compressor operative speed $\omega_{min\text{-}comp\text{-}speed}$ is achieved, which is detected by the compressor speed transducer 53, the second inlet pressure controller 43 is enabled. Since the second inlet pressure controller 43 has a set-point pressure value P2 (steady-state turboexpander inlet pressure), which is lower than the pressure set-point P1 of the first inlet pressure controller 41, the second inlet pressure controller 43 generates a control signal, which will cause a pressure reduction in the turboexpander collector 22. This is achieved as follows.

The control signal generated by the second inlet pressure controller 43 is applied to the compressor speed controller 51. The latter acts upon the variable-speed mechanical coupling 31, increasing the speed of the output shaft thereof and thus the power transferred from the turboexpander 21 to the compressor 29 through the variable-speed mechanical coupling 31. The speed of the compressor 29 increases and the speed of the turboexpander 21 tends to drop. The turboexpander speed reduction is detected by the turboexpander speed transducer 61. The signal generated by the turboexpander speed transducer 61 is applied to the turboexpander speed controller 59, which causes a gradual opening of the variable inlet guide vanes 57A, 57B, increasing the flow rate through the turboexpander and thus maintaining the turboexpander rotary speed at or around the rated operating speed $\omega_{exp\text{-}operating}$.

The flow rate increase through the turboexpander 21 determined by the gradual opening of the variable inlet guide vanes 57A, 57B causes the pressure in the turboexpander collector 22 to drop until the steady-state turboexpander inlet pressure P2 is achieved. The pressure drop in the turboexpander collector 22 causes the first inlet pressure controller 41 to close the by-pass valve 47. Thus, once the steady-state turboexpander inlet pressure P2, i.e. the pressure set-point of the second inlet pressure controller is achieved, the entire working fluid circulating in the bottom, low-temperature thermodynamic cycle of the ORC system 5 flows through the turboexpander 21.

During this process the compressor by-pass valve 67 is gradually closed and the compressor 29 is placed in line in parallel with compressors 11A, 11B and starts processing the gaseous medium flowing in the pipeline.

The process is continued until the speed of the compressor 29 is brought to the full compressor operative speed $\omega_{comp\text{-}oper}$, which is within the compressor operating envelope, typically between minimum and maximum design operating speed. To fully exploit the available power from the waste heat recovery exchanger, the operating speed can be set to the maximum design operating speed (see block 69). The turboexpander inlet pressure is maintained at steady-state turboexpander inlet pressure P2 and the turboexpander speed is maintained at 100% of its rated operating speed $\omega_{exp\text{-}operating}$.

The compressor can be placed under load by closing the compressor by-pass valve 67 and the compressor load control is enabled.

The above described control method is such that, if the power available from the waste heat recovery system varies, the rotary speed of the turboexpander is maintained at its rated operating speed $\omega_{exp\text{-}operating}$, while the power transmitted through the variable-speed mechanical coupling 31 is modified, causing a variation of the compressor speed. For instance, if the waste heat available from the top, high-temperature thermodynamic cycle drops, the pressure in the turboexpander collector 22 tends to drop, since less thermal energy is available for the bottom, low-temperature thermodynamic cycle. The second inlet pressure controller 43 generates a control signal which is applied to the compressor speed controller 51. The latter generates in turn a signal, which reduces the torque available at the output shaft of the variable-speed mechanical coupling 31, thus reducing the compressor speed. Vice-versa, if more waste heat is available, this will cause a pressure increase in the turboexpander inlet collector 22, which will cause the second inlet pressure controller 43 to generate a signal that is applied to the compressor speed controller 51, the latter generating a signal which will increase torque available at the output shaft of the variable-speed mechanical coupling 31, thus increasing the compressor speed.

Variation of the torque required by the compressor 29 at the output shaft of the variable-speed mechanical coupling 31 causes a deviation of the rotary speed of turboexpander 21 from the rated operating speed $\omega_{exp\text{-}operating}$ of the turboexpander. The turboexpander speed control loop including the turboexpander speed transducer 61 and the turboexpander speed controller 59 will provide a control signal which, acting upon the variable inlet guide vanes 57A, 57B, will maintain the turboexpander rotating speed at or around the rated operating speed $\omega_{exp\text{-}operating}$, thus counter-acting the effect of the torque variation due to the signal generated by the compressor speed controller 51.

According to some embodiments, the control system of the ORC system 5 can include devices enabling the system to cope with requests for quick partialization of the flow rate processed through compressor 29. According to embodiments of the system disclosed herein, if the compressor speed needs to be reduced, e.g. due to a decreased demand from the pipeline 10, a corresponding partialization signal can be provided by a block 71 to a selector 73, which selects the minimum one between the partialization signal and the signal from the second inlet pressure controller 43. This selected minimum signal is then applied to the compressor speed controller 51. Thus, if an abrupt reduction of flow rate from compressor 29 is required, the partialization signal overrides the second inlet pressure controller 43 and causes a rapid reduction of speed of the output shaft of the variable-speed mechanical coupling 31. This will in turn cause the pressure in the turboexpander inlet collector 22 to increase above P1 and the first inlet pressure controller 41 to open the by-pass valve 47.

According to further embodiments, the control system can be further provided with devices which ensure a reduction of the turboexpander flow rate which is quicker than the one obtained as described above, e.g. if a fast flow rate reduction is needed.

For this purpose a feed-forward control block 75 can be provided between the compressor speed controller 51 and the turboexpander speed controller 59. The flow rate reduction signal from block 71 will in this case cause the feed-forward block to generate a feed-forward control signal which overrides the above described speed control process and which will be directly applied to the turboexpander speed controller 59, which will in turn generate a control signal that will rapidly close the variable inlet guide vanes 57A, 57B.

According to some embodiments, the control arrangement can further include devices preventing the turboexpander inlet pressure to drop below a minimum allowable pressure P3, which can be for instance 0.5 bar less than P2. According to embodiments disclosed herein, this is achieved by the selector 62 and the third inlet pressure controller 45. The latter has a set-point pressure P3 lower than the set-point pressure P2 of the second inlet pressure controller 43. If the set-point pressure P2 is 39.5 bar, the set-point pressure P3 of the third inlet pressure controller 43 can be for instance 39.0 bar.

If the pressure in the turboexpander inlet collector 22 drops to P3, e.g. due to a malfunctioning of the waste heat recovery exchanger 17, or of the heat transfer loop 7, or else due to a drop in the waste heat available, the third inlet pressure controller 45 generates a control signal, which is applied to selector 62. The latter selects the lowest one between the control signal of the third inlet pressure controller 45 and the turboexpander speed controller 59. If the third inlet pressure controller 45 detects a pressure drop, the signal thereof will override the signal from the turboexpander speed controller 59 and be passed by the selector 62 to the variable inlet guide vanes 57A, 57B causing a quick reduction of flow through the turboexpander 21.

Alternative control methods for both start-up and load control are possible. A further exemplary embodiment of the control method will be described here below with reference to the schematic of FIG. 4.

Figure 4:
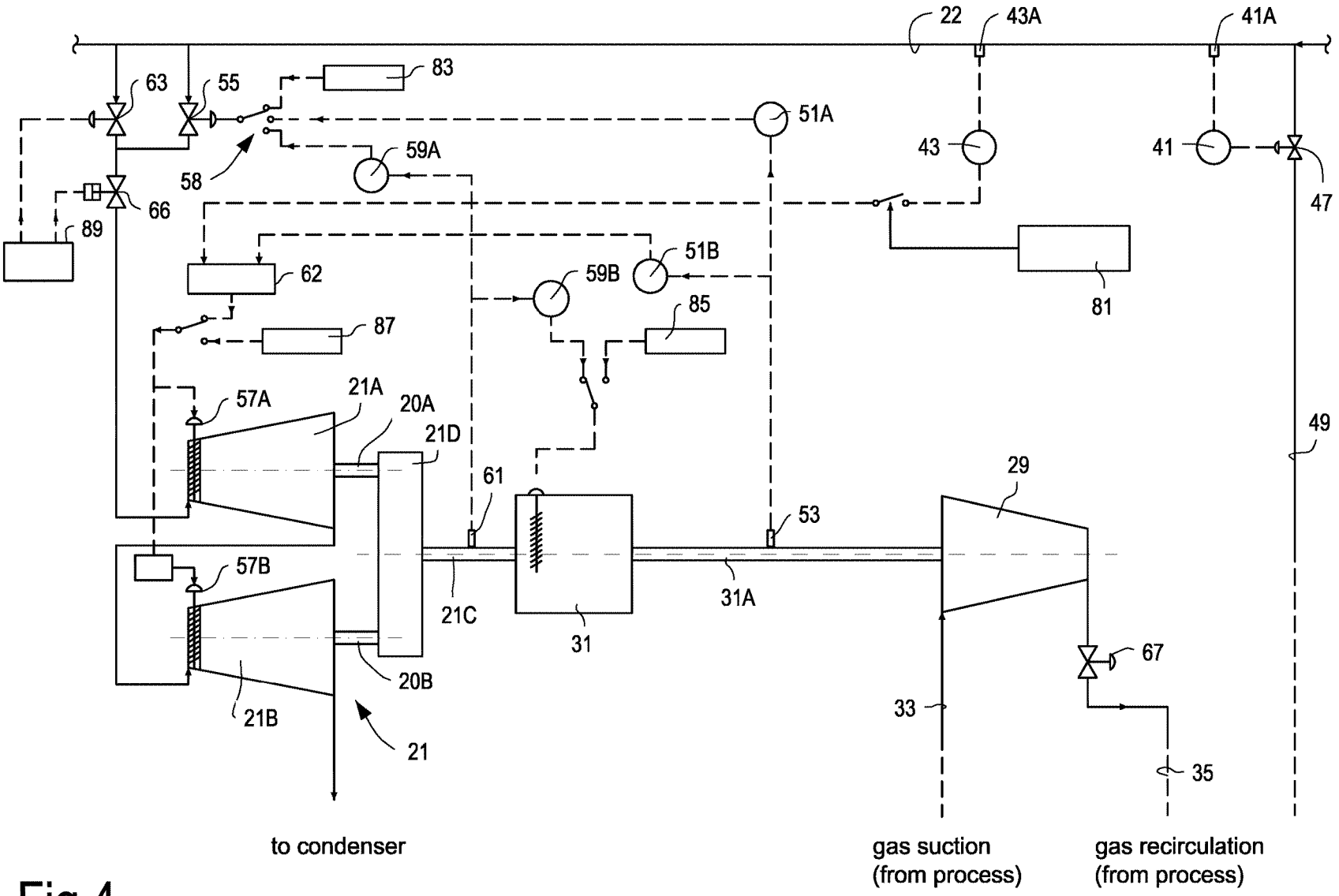
FIG. 4 illustrates a schematic of the control system for the bottom, low-temperature thermodynamic cycle according to a further embodiment.

Elements and components of FIG. 4 corresponding to elements and components shown in FIGS. 2 and 3 are labeled with the same reference numbers. The layout of the system of the embodiment shown in FIG. 4 will be shortly summarized. The operation thereof will then be described in detail.

In FIG. 4 the main components of the ORC system 5, in combination with an exemplary arrangement of devices used for controlling the rotary machines thereof, are shown. The turboexpander 21 is here illustrated as an in integrally geared turboexpander, comprised of a first, high-pressure stage 21A and a second, low-pressure stage 21B. Each turboexpander stage 21A, 21B comprises an output shaft 20A, 20B. The output shafts 20A, 20B are drivingly connected to a gearbox 21D. Power is delivered from the turboexpander 21 through a turboexpander output shaft 21C towards a variable-speed mechanical coupling, again labeled 31. The variable-speed mechanical coupling 31 is in turn connected to compressor 29.

In FIG. 4 a first inlet pressure controller 41 and a second inlet pressure controller 43 are shown. The first inlet pressure controller 41 is configured for controlling a by-pass valve 47 placed on a by-pass line 49. The by-pass line 49 connects the turboexpander inlet collector 22 to the recuperator 23 or to the condenser 25, bypassing the turboexpander 21. Reference number 41A indicates a pressure transducer, the signal whereof is applied to the first inlet pressure controller 41. Reference number 43A indicates a pressure transducer, the signal whereof is applied to the second inlet pressure controller 43.

A first compressor speed controller 51A and a second compressor speed controller 51B are connected to a compressor speed transducer 53, which detects the rotary speed of the output shaft 31A of the variable-speed mechanical coupling 31. The first compressor speed controller 51A can be functionally connected to a start-up valve 55. The second compressor speed controller 51B is connected to a low-signal selector 62. The output of the low-signal selector 62 is applied to variable inlet guide vanes (IGV) 57A, 57B of the first, high-pressure stage 21A of the turboexpander 21 and of the second, low-pressure stage 21B of the turboexpander 21. In other embodiments, e.g. if a single-stage turboexpander is provided, only one set of variable inlet nozzles or inlet guide vanes will be required.

Also in the embodiment of FIG. 4 the variable inlet guide vanes 57A, 57B can be linked so as to be controlled by a single control signal, i.e. the output signal of low-signal selector 62.

Reference number 59A designates a first turboexpander speed controller, which is functionally connected to a turboexpander speed transducer 61 and receives a turboexpander speed signal therefrom. In the embodiment of FIG. 4 the turboexpander speed transducer 61 detects the rotary speed of shaft 21C. In other embodiments the turboexpander speed transducer 61 can be applied to shaft 20A and/or to shaft 20B or to all three shafts 20A, 20B and 21C.

The output of first turboexpander speed controller 59A can be selectively applied, through a switching block 58, to the turboexpander start-up valve 55.

A second turboexpander speed controller 59B can receive a signal from the turboexpander speed transducer 61. The output of the second turboexpander speed controller 59B can be selectively applied to the variable speed mechanical coupling 31.

According to some embodiments, a controlled turboexpander inlet valve 63 can be arranged in parallel to the turboexpander start-up valve 55. In some embodiments, an on/off valve 66 can be further provided and arranged in series to turboexpander inlet valve 63 and turboexpander start-up valve 55. In other embodiments, a single valve or a two-valve arrangement can be used, instead of the three-valve system 55, 63, 66.

Further elements for controlling the operation of the ORC system 5 can include a compressor by-pass valve 67, which connects the compressor delivery side with the compressor suction side, directly or with a gas recirculation line, not shown. The compressor by-pass valve 67 can be an anti-surge valve of the compressor 29.

Block 81 schematically represents a pressure control enable command. Reference numbers 83, 85, 87 schematically represent blocks for selective enabling/disabling of certain control loops of the system described so far. Block 89 represents a control software logic, which control the opening and closing of valves 63 and 66.

The operation of the system of FIG. 4 will now be described in detail.

The initial conditions are the same as previously described in connection with the method performed by the system of FIG. 3. The on/off valve 66, the start-up valve 55 and the turboexpander inlet valve 63 are closed. The by-pass valve 47 regulates the pressure in the turboexpander inlet collector 22 under the control of the first inlet pressure controller 41. The variable inlet guide vanes 57A, 57B of the turboexpander 21 are in an embodiment fully open. The variable-speed mechanical coupling 31 is set at minimum speed. The by-pass valve 67 of the compressor 29 is fully open.

When waste heat is available from the top, high-temperature thermodynamic cycle 3, the working fluid in the bottom, low-temperature thermodynamic ORC system 5 starts heating up and is pressurized. When the pressure in the turboexpander inlet collector 22 achieves the start-up pressure P1, the start-up procedure can initiate. Valve 66 is fully opened while the turboexpander inlet valve 63 and the start-up valve 55 are closed. The turboexpander rotation is initiated under the control of the first turboexpander speed controller 59A acting upon start-up valve 55, which is gradually opened. For this purpose, a turboexpander speed control loop is enabled. The turboexpander speed control loop can be comprised of the turboexpander speed transducer 61 and the first turboexpander speed controller 59A. Switching block 58 schematically indicates the option of enabling this turboexpander control loop. The signal from the first turboexpander speed controller 59A is applied to the start-up valve 55.

The abovementioned turboexpander speed control loop 61, 59A gradually opens the turboexpander start-up valve 55, thus increasing the flow rate of working fluid that flows from the turboexpander inlet collector 22 through the turboexpander 21. The variable inlet guide vanes 57A, 57B are maintained partially or fully open.

The turboexpander rotation speed is increased until the warm-up speed $\omega_{warm\text{-}up}$ is achieved. The turboexpander 21 is maintained at warm-up speed for a warm-up time interval $\Delta t_{warm\text{-}up}$. The compressor 29 is either stationary or rotates slowly as the variable-speed mechanical coupling 31 is set at a minimum speed value. No compressor speed control is required at this stage and therefore no such compressor speed control is enabled.

After expiration of the warm-up time interval $\Delta t_{warm\text{-}up}$, acceleration of the turboexpander 21 from the warm-up speed $\omega_{warm\text{-}up}$ up to its full operating, i.e. rated operating speed $\omega_{exp\text{-}operating}$, is started. Acceleration is obtained by further gradually opening the start-up valve 55, still under the control of the first turboexpander speed controller 59A.

Once the rated operating speed $\omega_{exp\text{-}operating}$ of the turboexpander 21 has been achieved, the turboexpander speed control through the start-up valve 55 is disabled and a compressor speed control is enabled.

The compressor speed control operates based on a speed signal from compressor speed transducer 53, which is part of a compressor speed control loop including the first compressor speed controller 51A. While the variable inlet guide vanes or nozzles 57A, 57B of the turboexpander 21 are maintained fully open, the compressor speed is increased by further opening the start-up valve 55, so that the flow rate of the working fluid through the turboexpander 21 is further increased.

To prevent the turboexpander from accelerating above its rated operating speed $\omega_{exp\text{-}operating}$ as the start-up valve 55 further opens, a turboexpander speed control loop acting upon the variable-speed mechanical coupling 31 is provided and enabled at this stage. According to some embodiments, the turboexpander speed control loop includes now the turboexpander speed transducer 61 and the second turboexpander speed controller 59B. The turboexpander speed control loop 59B, 61 acts upon the variable-speed mechanical coupling 31 based on the speed signal from the turboexpander speed transducer 61. The variable-speed mechanical coupling 31 is controlled to increase the torque transferred from the turboexpander 21 to the compressor 29, thus increasing the output speed of the variable-speed mechanical coupling 31. The additional power made available at the turboexpander 21 due to increased flow rate of the working fluid caused by gradual continued opening of the start-up valve 55 is transferred to the compressor 29 causing acceleration thereof, while maintaining the speed of turboexpander 21 around the rated operating speed $\omega_{exp\text{-}operating}$.

In short, a dual speed control loop is now enabled. A compressor speed control loop comprising the compressor speed transducer 53 and the first compressor speed controller 51A is used to gradually open the start-up valve 55. The turboexpander 21 is maintained at its rated operating speed $\omega_{exp\text{-}operating}$ by the turboexpander speed control loop comprising the turboexpander speed transducer 61 and the second turboexpander speed controller 59B. The latter, based on the actual turboexpander speed, acts upon the variable-speed mechanical coupling 31, increasing the amount of power transferred to compressor 29.

The acceleration of the compressor 29 continues until a minimum compressor operative speed $\omega_{min\text{-}comp\text{-}speed}$ is achieved. Once said minimum compressor operative speed co n-comp-speed has been achieved, the start-up phase is completed. The compressor by-pass valve 67 is still open, the variable inlet guide vanes 57A, 57B of the turboexpander 21 are still fully open. The pressure in the turboexpander inlet collector 22 is under the control of the first inlet pressure controller 41, set at start-up pressure P1. A portion of the working fluid is still by-passed through by-pass line 49 and by-pass valve 47, which is controlled by first inlet pressure controller 41.

Once the minimum compressor operative speed $\omega_{min\text{-}comp\text{-}speed}$ is achieved, the start-up valve 55 is ramped to its full open position. The turboexpander speed control loop 61, 59B maintains the rotary speed of the turboexpander 21 at the rated turboexpander operating speed $\omega_{exp\text{-}operating}$ by acting upon the variable-speed mechanical coupling 31. Control of the compressor speed is now taken over by second compressor speed controller 51B, which maintains the speed of compressor 29 at minimum compressor operative speed $\omega_{min\text{-}comp\text{-}speed}$ acting upon the variable inlet guide vanes 57A, 57B.

Once the turboexpander start-up valve 55 is fully open, the turboexpander inlet valve 63 is opened and the turboexpander start-up valve 55 is subsequently fully closed. The working fluid is now delivered to the turboexpander 21 through valves 63, 66. A different valve-opening and closing sequence can be used, should a different valve arrangement be used, as mentioned previously with respect to FIG. 3.

The by-pass valve 47 is still at least partly open. The working fluid flows partly through the turboexpander 21 and partly through the by-pass line 49. Full flow through the turboexpander 21 will be achieved in the next step, to be described, during which the compressor 29 is accelerated from the minimum compressor operative speed $\omega_{min\text{-}comp\text{-}speed}$ to full compressor operative speed $\omega_{comp\text{-}oper}$.

Once the compressor speed increases above the minimum compressor operative speed $\omega_{min\text{-}comp\text{-}speed}$, the compressor by-pass valve 67 can be gradually closed, such that the compressor 29 is placed in line and starts processing the gaseous medium in the pipeline 10, in parallel with compressors 11A, 11B.

The final step of compressor acceleration is performed under the control of the compressor speed control loop, comprising the compressor speed transducer 53 and the second compressor speed controller 51B, and of the pressure control loop, comprising the second inlet pressure transducer 43A and the second inlet pressure controller 43. Both control loops act on the variable inlet guide vanes 57A, 57B through a low-signal selector 62.

The output signal from the second compressor speed controller 51B is now applied to the variable inlet guide vanes 57A, 57B of the turboexpander 21. Since the actual compressor speed is $\omega_{min\text{-}comp\text{-}speed}$ and shall be increased to achieve full compressor operative speed $\omega_{comp\text{-}oper}$, the second compressor speed controller 51B generates a signal aimed at further opening the variable inlet guide vanes 57A, 57B of the turboexpander 21, so that more power is made available, thanks to increased working fluid flow through the turboexpander 21, in order to increase the compressor speed. In case the pressure detected by the second inlet pressure transducer 43A falls below a second inlet pressure set point P2 of the second inlet pressure controller 43, opening of the variable inlet guide vanes 57A, 57B will be limited by the inlet pressure controller 43 through the low-signal selector 62.

The turboexpander speed control loop, comprising turboexpander speed transducer 61 and second turboexpander speed controller 59B, prevents the turboexpander 21 from accelerating beyond its rated operating speed $\omega_{exp\text{-}operating}$. This is obtained by the turboexpander speed control loop 61, 59B acting upon the variable-speed mechanical coupling 31, such that the increased power made available by opening of the variable inlet guide vanes 57A, 57B, under the control of the second compressor speed controller 51B and of the second inlet pressure controller 43, will be transferred to shaft 31A for accelerating the compressor 29.

At the same time the second inlet pressure controller 43 generates a signal, which is aimed at maintaining the pressure in the turboexpander inlet collector 22 at steady-state turboexpander inlet pressure P2, i.e. the pressure set-point of the second inlet pressure controller 43, preventing the turboexpander inlet pressure from dropping below the second pressure set-point P2. Since P2 is lower than the setup pressure P1 of the first inlet pressure controller 41, the latter has closed the by-pass valve 47. The entire working fluid will now flow through the turboexpander 21.

Thus, during this phase the signal from the second inlet pressure controller 43 is applied to low-signal selector 62, whereto also the signal from the compressor speed control loop is applied. The smallest one of the two signals received by low-signal selector 62 is used to control the variable inlet guide vanes 57A, 57B. The second compressor speed controller 51B will generate a signal aimed at accelerating the compressor up to full compressor operative speed $\omega_{comp\text{-}oper}$, while the action thereof will be balanced by the control signal from the second inlet pressure controller 43, if the pressure in the turboexpander inlet collector 22 tends to drop below the set-point pressure P2.

According to some embodiments, in steady state conditions, two controllers are active and can selectively act upon the variable inlet guide vanes 57A, 57B of the turboexpander 21. A first controller is the second inlet pressure controller 43, which controls the pressure in the turboexpander inlet collector 22. A further controller is the second compressor speed controller 51B. The signals of both controllers are applied to the low-signal selector 62. According to some embodiments, the low-signal selector 62 selects the smaller one of the two controller signal, which is then used to act upon the variable inlet guide vanes 57A, 57B of the turboexpander.

If for instance the power available from the top, high-temperature thermodynamic cycle decreases, a pressure drop in the turboexpander inlet collector 22 detected by the second inlet pressure controller 43 will provide a signal intended to reduce the pressure drop by closing the variable inlet guide vanes 57A, 57B of the turboexpander 21. If more power is available from the top, high-temperature thermodynamic cycle, the pressure increase in the turboexpander inlet collector 22 caused thereby is detected by the second inlet pressure controller 43, which will generate an opposite control signal, aimed at reducing the pressure increase by opening the variable inlet guide vanes 57A, 57B.

At the same time, fluctuations of the compressor speed are detected by the compressor speed transducer 53 and will cause a control signal to be generated by the second compressor speed controller 51B. This signal is intended to cause opening or closing of the variable inlet guide vanes 57A, 57B, to respectively increase or decrease the compressor speed.

As the two control signals from second inlet pressure controller 43 and second compressor speed controller 51B are applied to the low-signal selector 62, the latter will select the smallest one of the two signals, which is finally applied to the variable inlet guide vanes 57A, 57B.

The compressor speed can be modulated if so required, to speed values which are higher or lower than the full compressor operative speed $\omega_{comp\text{-}oper}$. For instance the compressor speed can be modulated in order to meet (or help meeting) specific process conditions in the pipeline 10, whereto the compressor is connected, e.g. dictated by increasing or decreasing flow or pressure conditions in the pipeline header.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What we claim is:

1. A power converting system, the power converting system comprising:

a source of waste heat;

an organic Rankine cycle system, comprised of: at least a turboexpander comprising variable inlet guide vanes, at least a rotating load mechanically coupled to the turboexpander and driven thereby, a variable-speed mechanical coupling between the turboexpander and the rotating load, and a speed control arrangement, configured and arranged for controlling the turboexpander and the rotating load, comprising at least a first turboexpander speed control loop comprised of a turboexpander speed transducer and a first turboexpander speed controller.

2. The system of claim 1, further comprising:

a gas turbine system comprised of at least one gas turbine engine and at least a further rotating load driven by said at least one gas turbine engine; and a heat exchange system for transferring waste heat from the gas turbine system to the organic Rankine cycle system; wherein said waste heat source comprises exhaust gas from the gas turbine system.

3. The system of claim 1, wherein the further rotating load comprises at least one further turbomachine.

4. The system of claim 1, wherein the rotating load comprises at least one turbomachine.

5. The system of claim 1, wherein the organic Rankine cycle system comprises a turboexpander inlet collector and at least an inlet pressure controller arranged and configured to maintain the pressure in the turboexpander inlet collector at a steady-state turboexpander inlet pressure.

6. The system of claim 5, further comprising a further inlet pressure controller, arranged and configured to control a by-pass valve, connecting the turboexpander inlet collector to a low-pressure side of the organic Rankine cycle system, the further inlet pressure controller having a pressure set-point higher than the steady-state turboexpander inlet pressure.

7. The system of claim 1, wherein the first turboexpander speed controller is configured and arranged for applying a control signal selectively to a start-up valve and to variable inlet guide vanes of the turboexpander; or for applying a control signal to the start-up valve.

8. The system of claim 1, wherein the turboexpander speed controller is further configured and arranged for selectively applying a control signal to the variable-speed mechanical coupling.

9. The system of claim 1, wherein the speed control arrangement further comprises a second turboexpander speed control loop comprised of a second turboexpander speed controller, and wherein the second turboexpander speed control loop is configured and arranged for selectively applying a control signal to the variable-speed mechanical coupling.

10. The system of claim 1, wherein the speed control arrangement further comprises at least a first load speed control loop comprised of a load speed transducer and of a first load speed controller; wherein the first load speed controller is configured and arranged for selectively applying a control signal to the variable-speed mechanical coupling; and wherein the first load speed controller is configured and arranged for selectively applying a control signal to variable inlet guide vanes of the turboexpander.

11. The system of claim 10, wherein the first load speed controller is configured and arranged for selectively applying a control signal to a start-up valve.

12. The system of claim 10, wherein the speed control arrangement further comprises a second load speed control loop comprised of a second load speed controller; and wherein the second load speed control loop is configured and arranged for selectively applying a control signal to variable inlet guide vanes of the turboexpander.

13. The system of claim 1, wherein the speed control arrangement is configured and arranged for performing a start-up phase of the organic Rankine cycle system, including a step of accelerating the turboexpander at a warm-up speed and a subsequent step of accelerating the turboexpander at a rated operating speed; and wherein the speed control arrangement is configured and arranged for accelerating the turboexpander at the warm-up speed by acting upon a start-up valve.

14. The system of claim 13, wherein the speed control arrangement is configured and arranged for maintaining the turboexpander at warm-up speed for a warm-up time interval.

15. The system of claim 13, wherein the speed control arrangement is configured and arranged for accelerating the rotating load at a minimum operative speed and subsequently accelerating the rotating load at a full operative speed; and wherein the speed control arrangement is configured and arranged for accelerating the rotating load towards the minimum operative speed after the turboexpander has achieved the full operative speed.

16. The system of claim 15, wherein the speed control arrangement is configured and arranged for accelerating the rotating load from the minimum operative speed to the full operative speed by acting upon the variable-speed mechanical coupling; and wherein the speed control arrangement is configured and arranged for maintaining the turboexpander speed at rated operating speed during acceleration of the rotating load from minimum operative speed to the full operative speed by acting upon variable inlet guide vanes of the turboexpander.

17. The system of claim 12, wherein the speed control arrangement is configured and arranged for accelerating the rotating load towards a full operative speed $\omega$ by acting upon variable inlet guide vanes of the turboexpander, while maintaining the turboexpander at rated operating speed by acting upon the variable-speed mechanical coupling.

18. A method for managing a power conversion system including an organic Rankine cycle system thermally coupled to a waste heat source and comprising: at least a turboexpander comprising variable inlet guide vanes; at least a rotating load mechanically coupled to the turboexpander and driven thereby; a variable-speed mechanical coupling between the turboexpander and the rotating load; and a speed control arrangement, configured and arranged for controlling the turboexpander and the rotating load, comprising at least a first turboexpander speed control loop comprised of a turboexpander speed transducer and a first turboexpander speed controller; the method comprising:

the step of acting upon the variable-speed mechanical coupling to control the power transmitted from the turboexpander to the rotating load.

19. The method of claim 18, further comprising the steps of:

accelerating the turboexpander to a first, warm-up speed and subsequently accelerating the turboexpander to a rated operating speed higher than the warm-up speed;

accelerating the rotating load to a minimum load operative speed and subsequently accelerating the rotating load to a full operative speed higher than the minimum load operative speed, while maintaining the turboexpander at or around the rated operating speed.

* * * * *